US009073224B2

(12) United States Patent
Mangan, IV

(10) Patent No.: US 9,073,224 B2
(45) Date of Patent: Jul. 7, 2015

(54) BOX OPENER PEN TOP

(71) Applicant: James Joseph Mangan, IV, Durango, CO (US)

(72) Inventor: James Joseph Mangan, IV, Durango, CO (US)

( * ) Notice: Subject to any disclaimer, the term of this patent is extended or adjusted under 35 U.S.C. 154(b) by 128 days.

(21) Appl. No.: 13/649,432

(22) Filed: Oct. 11, 2012

(65) Prior Publication Data

US 2013/0145622 A1 Jun. 13, 2013

(51) Int. Cl.
*B26B 11/00* (2006.01)
*B26B 1/02* (2006.01)

(52) U.S. Cl.
CPC .. *B26B 11/00* (2013.01); *B26B 1/02* (2013.01)

(58) Field of Classification Search
CPC ..... B26B 27/005; B26B 3/00; B26B 1/00; B26B 1/02; B26B 1/04; B26B 1/10; B26B 11/00
USPC ..... 30/2, 153, 155–161, 340, 342, 296.1, 30/298, 298.4
See application file for complete search history.

(56) References Cited

U.S. PATENT DOCUMENTS

| | | | | | |
|---|---|---|---|---|---|
| 1,085,779 | A | * | 2/1914 | Zohm | 30/123 |
| 1,124,651 | A | * | 1/1915 | Peterson | 30/123 |
| 1,368,944 | A | * | 2/1921 | Kurose | 401/20 |
| 1,441,103 | A | * | 1/1923 | McGinnis | 30/164.9 |
| 1,517,253 | A | * | 12/1924 | Schick | 30/296.1 |
| 2,215,216 | A | * | 9/1940 | Gits et al. | 30/320 |
| 2,287,703 | A | * | 6/1942 | Nyberg et al. | 30/123 |
| 4,622,744 | A | * | 11/1986 | Nogueira | 30/155 |
| 5,285,574 | A | * | 2/1994 | Feltner | 30/2 |
| 5,865,552 | A | * | 2/1999 | Manno | 401/195 |
| 6,076,986 | A | * | 6/2000 | Manno | 401/195 |
| D436,126 | S | * | 1/2001 | Rosenbaum | D19/36 |
| 6,273,852 | B1 | * | 8/2001 | Lehe et al. | 600/30 |
| 6,331,087 | B1 | * | 12/2001 | Wang | 401/195 |
| 6,698,100 | B2 | * | 3/2004 | Yan | 30/298.4 |
| 7,774,941 | B2 | * | 8/2010 | Johnson et al. | 30/162 |
| 8,347,509 | B2 | * | 1/2013 | Votolato | 30/156 |
| 2003/0019337 | A1 | * | 1/2003 | Hatanaka | 83/13 |
| 2007/0006469 | A1 | * | 1/2007 | Williams | 30/298 |
| 2010/0154219 | A1 | * | 6/2010 | Huett | 30/2 |
| 2012/0030949 | A1 | * | 2/2012 | Ping | 30/156 |

* cited by examiner

*Primary Examiner* — Ned Landrum
*Assistant Examiner* — Richard Crosby, Jr.
(74) *Attorney, Agent, or Firm* — DeLio, Peterson & Curcio, LLC; Peter W. Peterson

(57) ABSTRACT

A foldable box opener is securable to a writing or pointing implement and has a blade mount having a collar attachable to a top portion of the writing implement and a portion adjacent the collar, with the offset portion including an opening extending through the offset portion, a blade including a first blade edge and a second blade edge opposite the first blade edge, and a pin attached to the blade and the collar allowing rotation of the blade about the collar. The blade first edge is tapered to have a smaller thickness than the second edge, with the first edge thickness being sufficiently narrow to cut a cardboard box or packaging tape while being sufficiently wide to prevent a user's skin from being pierced or lacerated.

5 Claims, 3 Drawing Sheets

BOX OPENER PEN TOP

BACKGROUND OF THE INVENTION

1. Field of the Invention

The present invention relates to a box opener which is mountable to the top portion of a pen or other marking device.

2. Description of Related Art

The new era of internet transactions have made purchasing products easier and more economical than ever. Customers often purchase product by mail or from the Internet with delivery by courier services or the U.S. Postal Service. The packages include packaging tape to secure the flaps of the shipping container as well as packaging tape directly on the product container. A box opener may be used to puncture and slice the tape to allow the container flaps to unfold and allow access to the purchased product. Usually, the purchaser will not have a box opener handy, so will opt to use a key tip, or just pull the packaging tape off of the box, each method of which has its drawbacks.

One of the major safety issues with a box opener is that at least one edge of the blade is sharp, presenting a major safety issue. Packaging tape does not require the use of a sharp edged tool when puncturing and slicing the tape. A screwdriver or a house key is usually sufficient to cut the packaging tape holding the flaps together on a cardboard box. However, such devices are not always handy within reach.

SUMMARY OF THE INVENTION

Bearing in mind the problems and deficiencies of the prior art, it is therefore an object of the present invention to provide a device for safely cutting packaging tape on a cardboard box.

It is another object of the present invention to provide a device attachable to a writing implement and able to safely cut packaging tape on a sealed cardboard box.

A further object of the invention is to provide a retractable tape cutter for safely cutting packaging tape.

Still other objects and advantages of the invention will in part be obvious and will in part be apparent from the specification.

The above and other objects, which will be apparent to those skilled in the art, are achieved in the present invention which is directed to a foldable box opener securable to a writing or pointing implement comprising a blade mount having a collar attachable to a top portion of the writing implement and a portion adjacent the collar, with the offset portion including an opening extending through the offset portion, a blade including a first blade edge and a second blade edge opposite the first blade edge, and a pin attached to the blade and the collar allowing rotation of the blade about the collar. The blade first edge is tapered to have a smaller thickness than the second edge, with the first edge thickness being sufficiently narrow to cut a cardboard box or packaging tape while being sufficiently wide to prevent a user's skin from being pierced or lacerated.

The blade may be rotatable from a first retracted position to a second extended position and from the second extended position to the first retracted position. The box opener may include a first tab attached to the blade which contacts the collar when the blade is in the extended position, and a second tab attached to the blade which contacts the collar when the blade is in the retracted position. The blade may have a front edge portion and an adjacent blade surface, and include a corner of at least about 90° between the front edge portion and the adjacent blade surface. The blade first edge may be tapered on one or two surfaces to a blunt edge. The blade mount may be removably attached to the writing implement body.

In another aspect, the present invention is directed to a method for using a box opener to cut packaging tape on a box comprising providing a writing implement and providing a box opener. The box opener has a blade mount with a collar attachable a top portion of the writing implement and a portion adjacent the collar, the offset portion including an opening extending through the offset portion, a blade including a first blade edge and a second blade edge opposite the first blade edge, and a pin attached to the blade and the collar allowing rotation of the blade about the collar. The blade first edge has a smaller thickness than the second edge, the first edge thickness being sufficiently narrow to cut a cardboard box or packaging tape while being sufficiently wide to prevent a user's skin from being pierced or lacerated. The method further includes initially attaching the collar to the writing implement, rotating the blade to an extended position, cutting the packaging tape with the blade, and rotating the blade to a retracted position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-9 of the drawings in which like numerals refer to like features of the invention.

Figure 1:
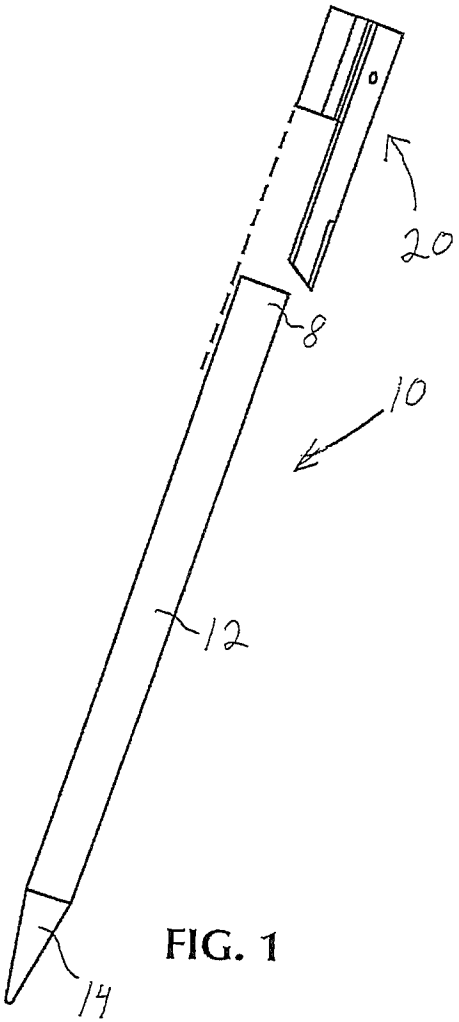
FIG. 1 is an exploded view of a writing implement and box opener in a folded position according to the present invention.

FIG. 1 shows a box opener 20 according to the present invention in a folded, closed or retracted position attachable to a writing implement 10. The writing implement 10 may include an elongated body 12, a pen, pencil or marker tip 14 at one end and a crown 8 at the opposing end. The pen tip 14 may be conical. The implement 10 may alternatively be a pointer. The implement 10 may be used in an otherwise normal fashion by grasping with the user's hand along the body 12.

Figure 3:
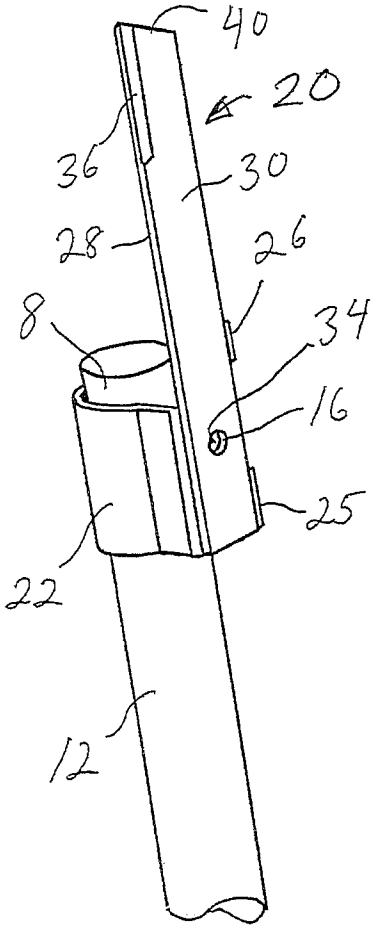
FIG. 3 is a perspective view of the box opener of FIG. 1 attached to the upper end of a writing implement with the box opener in a fully open position.
Figure 2:
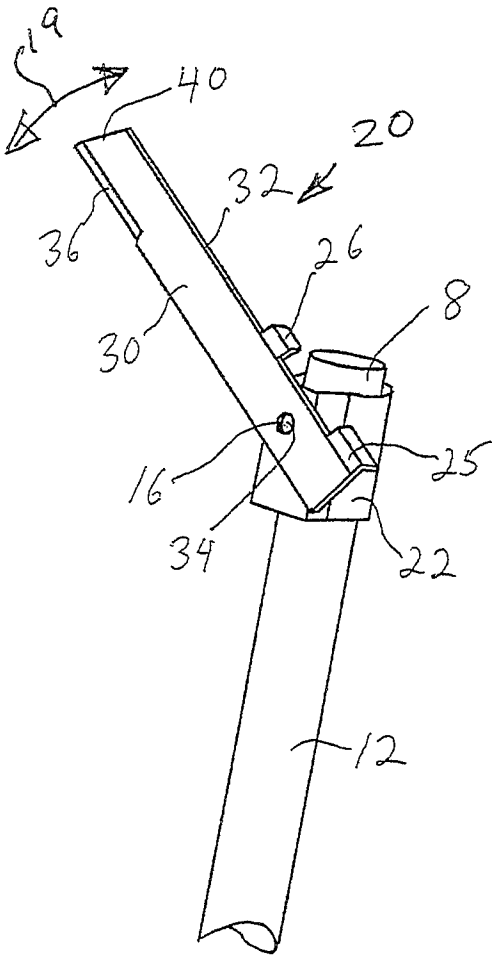
FIG. 2 is a perspective view of the box opener of FIG. 1 attached to the upper end of a writing implement with the box opener in an intermediate folding position.

To provide the ability to open boxes, packaging tape or the like, a blunt-edged box opener 20 is provided. FIGS. 2 and 3 show the box opener 20 attached to the crown 8 of the writing implement 10 with the box opener 20 having a blade 30 in a partially folded position and fully extended position respectively. The box opener 20 may be removably attached or secured to the implement 10 by slipping over the crown 8 in a sliding interference fit as shown. The box opener 20 may include a collar 22 which is attachable to the crown 8 of the writing implement 10. Alternately, the box opener 20 may be permanently attached to the crown 8 with fasteners, adhesive, or by integral formation of collar 22 with the implement body.

Figure 6:
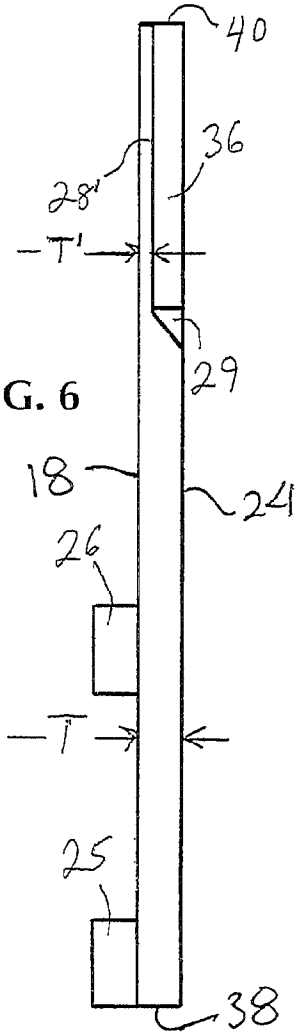
FIG. 6 is a front elevational view of the box opener blade according to the present invention.
Figure 5:
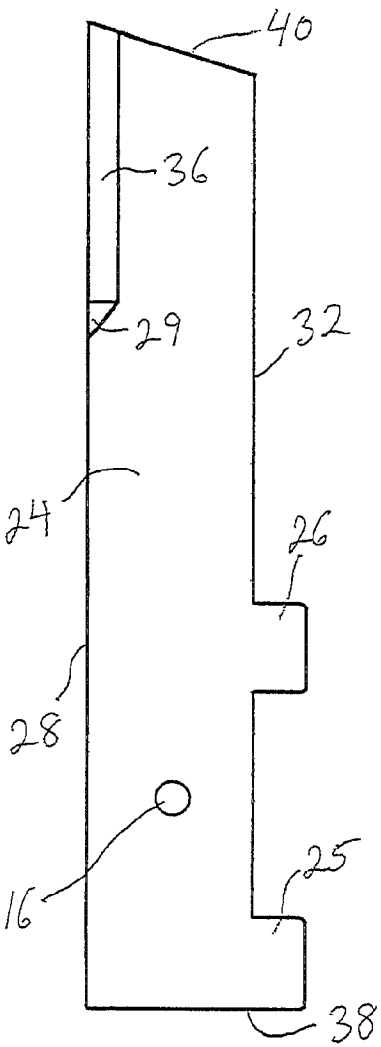
FIG. 5 is a side elevational view of the box opener blade according to the present invention.
Figure 4:
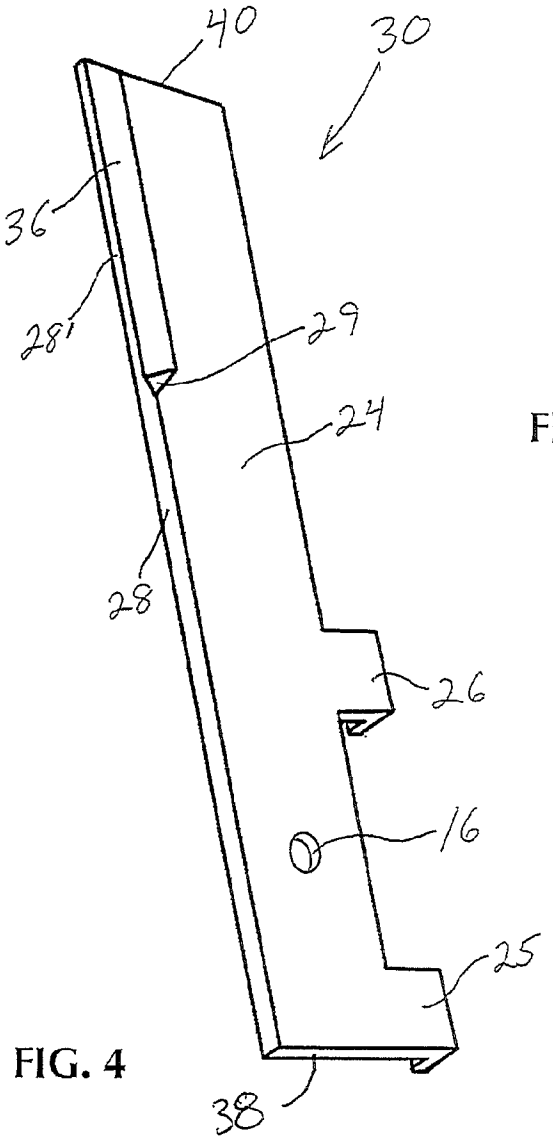
FIG. 4 is a perspective view of the box opener blade according to the present invention.

As shown in FIGS. 4-6, the blade 30 is formed as an elongated strip and has a front edge 28 and a rear edge 32 opposite the front edge 28 on either side of the strip width. The blade 30 includes opposite surfaces 18 and 24, each extending from the front edge 28 to the rear edge 32. The blade is rotatable in the directions shown by arrow 19 about pivot pin 34 extending outward from collar 22 through an opening 16, which opening extends through the blade from the face 24 to face 18. The blade 30 includes a partial bevel portion 36 along the front edge which extends from the blade tip end 40 toward the base end 38.

Figure 7:
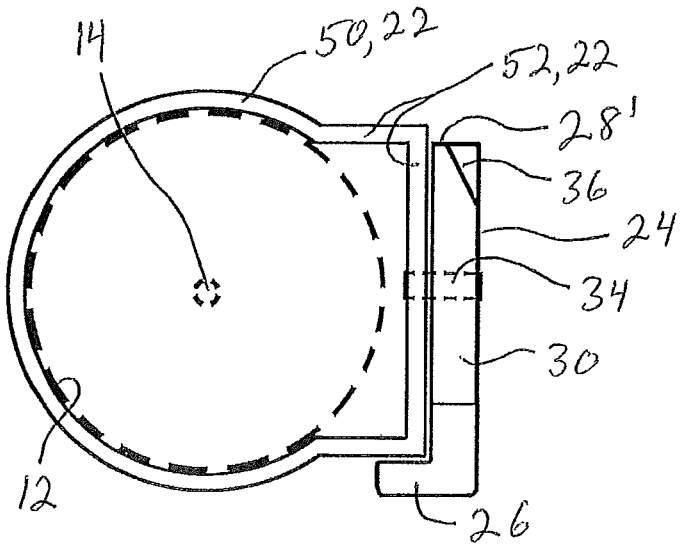
FIG. 7 is a bottom plan view of the box opener with the blade in a folded position and the writing implement in phantom lines according to the present invention.
Figure 8:
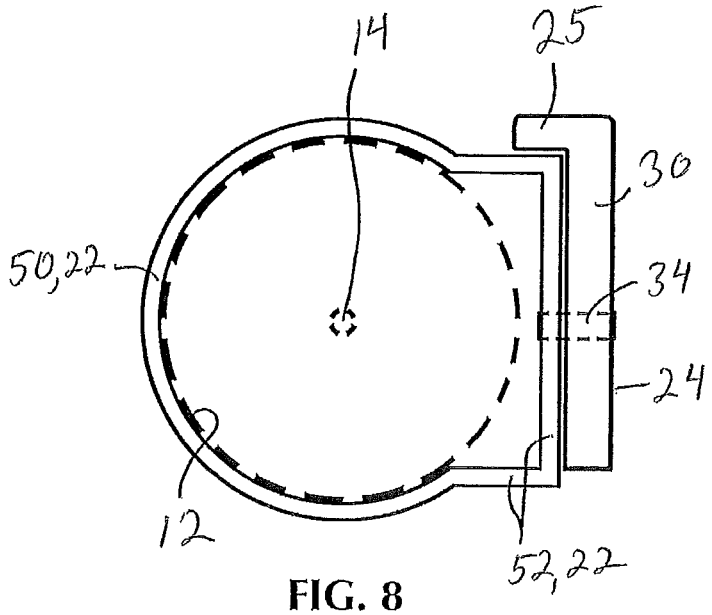
FIG. 8 is a bottom plan view of the box opener with the blade in an extended position according to the present invention.

The collar 22 is shown in the cross sectional views of FIGS. 7 and 8 and includes a cylindrical portion 50 and may include an offset portion 52. The offset portion 52 may intersect the cylindrical portion 50 to allow the pivot pin 34 extending through the offset portion to maintain the pivot pin 34 a spaced distance from the writing implement 10.

An open position stop tab 25 and a closed position stop tab 26 extend from the blade 30 on opposite sides of pivot opening 16. The open position stop tab 25 and closed position stop tab 26 may include at least a portion extending perpendicular to the flat face 18 of the blade 30. The open position stop tab 25 contacts the offset portion 52 when the box opener 20 is in the extended position with blade tip end 40 pointing outward beyond crown 8 in a direction away from pen tip 14 and parallel to the axis of implement 10, as in FIGS. 3 and 8. The closed position stop tab 26 contacts the offset portion 52 when the box opener 20 is in the retracted position with the blade adjacent implement body 12 and blade tip end 40 pointing toward pen tip 14 and parallel to the axis of implement 10, as in FIG. 8.

Figure 9:
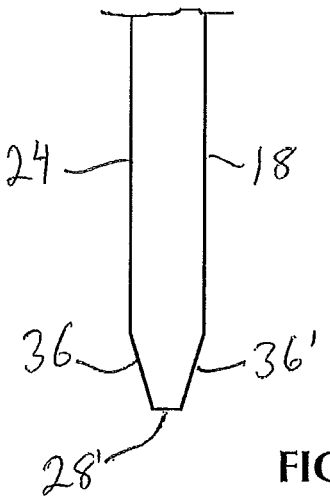
FIG. 9 is an alternate cross sectional view of the working edge of the blade.

The working edge of one embodiment of blade 30 used to cut cardboard boxes, packaging tape and the like is shown in FIGS. 4-6. Adjacent the blade tip end 40, which may be a straight edge perpendicular to or at an acute angle to front edge 28 (when seen in side view of FIG. 5), a partial bevel portion 36 on front edge 28 extends over only a portion of the width of the blade, and reduces the thickness of the blade from thickness T to thickness T' at the front edge portion 28'. Straight front edge portion 28' has a blunt edge between adjacent corners, and is perpendicular to blade surface 18 and sufficiently narrow to cut a cardboard box or packaging tape, but is also sufficiently wide to prevent a user's skin from being pierced or lacerated from the blade. Alternatively, the thinner working front edge portion 28' may be formed by partial bevels 36, 36' on both surfaces 24, 18, as shown in FIG. 9. As shown in the drawings, the blade has a corner of about 90° or more between front edge portion 28' and the adjacent blade surface 18, 24 or bevel surface 36, 36', when seen in end or cross sectional view as in FIG. 7 or 9. Additionally, it may be desirable to have the blade 30 and working front edge portion 28' of a configuration and dimension that would be acceptable to permit the box opener 20 to be carried aboard a commercial aircraft under Transportation Safety Agency regulations. Blade 30 may be made of any suitable metal or polymer.

In a method for using a box opener according to the present invention a user initially attaches the collar of the box opener to the writing implement. The user may then rotate the blade to an extended position, cut the packaging tape on a sealed box with the blade and rotate the blade to a retracted position. The box opener blade may include tabs which provide a rotational stop positions for extending and retracting the blade.

The box opener as described above provides a device for safely cutting packaging tape on a box. The device is attachable to a writing implement and able to safely cut packaging tape on a sealed cardboard box. The device includes a retractable tape cutting blade which cuts packaging tape without the danger of the user receiving a cut from the box opener.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A foldable box opener securable to a writing or pointing implement comprising:

a blade mount having a collar attachable to a top portion of the writing implement and an offset portion adjacent the collar, the offset portion including an opening extending through the offset portion;

an elongated blade having a length and a width and including a first blade edge on a side extending along the blade length and a second blade edge opposite the first blade edge extending along the blade length;

a first tab attached to the blade which contacts the collar when the blade is in the extended position and a second tab attached to the blade, the first tab contacting the offset portion when the blade is in the retracted position and second tab contacting the offset portion when the blade is in the extended position; the first and second tabs are disposed on the blade second edge; and a pin attached to the blade and the collar allowing rotation of the blade about the collar;

wherein the elongated blade has a face extending between the first blade edge and the second blade edge and the first tab extends in a direction perpendicular to the blade face; and whereby the blade first edge is tapered to have a smaller thickness than the second edge, the first edge thickness being sufficiently narrow to cut a cardboard box or packaging tape while being sufficiently wide to prevent a user's skin from being pierced or lacerated.

2. The box opener of claim 1 whereby the blade has a front edge portion and an adjacent blade surface, and including a corner of at least about 90° between the front edge portion and the adjacent blade surface.

3. A foldable box opener securable to a writing or pointing implement comprising:

a blade mount having a collar attachable to a top portion of the writing implement and an offset portion adjacent the collar, the offset portion including an opening extending through the offset portion;

an elongated blade having a length and a width and including a first blade edge on a side extending along the blade length and a second blade edge opposite the first blade edge extending along the blade length;

a first tab attached to the blade which contacts the collar when the blade is in the extended position and a second tab attached to the blade which contacts the collar when the blade is in the retracted position, the first and second tabs disposed on the blade second edge; and a pin attached to the blade and the collar allowing rotation of the blade about the collar;

whereby the blade first edge is tapered to have a smaller thickness than the second edge, the first edge thickness being sufficiently narrow to cut a cardboard box or packaging tape while being sufficiently wide to prevent a user's skin from being pierced or lacerated.

4. The box opener of claim 1 wherein the pin allows 180 degree rotation of the blade about the collar.

5. The box opener of claim 3 wherein the pin allows 180 degree rotation of the blade about the collar.

* * * * *